US011808068B2

(12) United States Patent
Daniels

(10) Patent No.: US 11,808,068 B2
(45) Date of Patent: Nov. 7, 2023

(54) DOOR LOCKING DEVICE

(71) Applicant: Osceola Cuts, LLC, Ocilla, GA (US)

(72) Inventor: William Bruce Daniels, Ocilla, GA (US)

(73) Assignee: Osceola Cuts, LLC, Ocilla, GA (US)

( * ) Notice: Subject to any disclaimer, the term of this patent is extended or adjusted under 35 U.S.C. 154(b) by 0 days.

(21) Appl. No.: 18/122,184

(22) Filed: Mar. 16, 2023

(65) Prior Publication Data

US 2023/0220712 A1 Jul. 13, 2023

Related U.S. Application Data

(63) Continuation of application No. 17/345,653, filed on Jun. 11, 2021, now Pat. No. 11,629,537.

(60) Provisional application No. 63/102,385, filed on Jun. 12, 2020.

(51) Int. Cl.

| | |
|---|---|
| ***E05D 11/06*** | (2006.01) |
| ***E05C 17/00*** | (2006.01) |
| ***E05D 11/10*** | (2006.01) |
| ***E05C 17/12*** | (2006.01) |
| ***E05C 19/18*** | (2006.01) |

(52) U.S. Cl.

CPC ..... *E05D 11/1007* (2013.01); *E05C 17/025* (2013.01); *E05C 17/12* (2013.01); *E05C 19/188* (2013.01); *E05Y 2900/132* (2013.01)

(58) Field of Classification Search

CPC ..... E05D 11/06; E05D 11/10; E05D 11/1007; E05D 11/1028; E05D 11/1014; E05D 11/0054; E05D 2011/10; E05D 2011/1028; E05D 2011/1092; E05Y 2201/218; E05Y 2201/224; E05Y 2900/132; E05F 5/06; E05C 17/00; E05C 17/025; E05C 17/12; E05C 19/188

See application file for complete search history.

(56) References Cited

U.S. PATENT DOCUMENTS

| | | | | |
|---|---|---|---|---|
| 3,174,179 | A * | 3/1965 | Benson | E05F 5/06 16/86 A |
| 3,206,793 | A | 9/1965 | Silverberg | |
| 3,971,100 | A | 7/1976 | Anop | |
| 5,560,080 | A | 10/1996 | Reed | |
| 6,702,341 | B1 | 3/2004 | Hudelson et al. | |
| 6,976,716 | B2 * | 12/2005 | Lin | E05C 19/182 292/296 |

(Continued)

OTHER PUBLICATIONS

Daniels, William Bruce; Non-Final Office Action U.S. Appl. No. 17/345,643, filed Jun. 11, 2021, dated Aug. 30, 2022, 8 pgs.

(Continued)

*Primary Examiner* — Chuck Y Mah

(74) *Attorney, Agent, or Firm* — Taylor English Duma LLP

(57) ABSTRACT

A door locking device includes a mounting plate configured to be mounted to the door; a reinforcement gusset extending outward from the mounting plate, the reinforcement gusset defining an extension portion; and a wall engagement member adjustably affixed to the extension portion of the reinforcement gusset and laterally offset from the mounting plate; wherein the wall engagement member is movable relative to the extension portion in a direction substantially perpendicular to the mounting plate, and wherein the extension portion is configured to confront a wall adjacent to the door.

16 Claims, 12 Drawing Sheets

(56) References Cited

U.S. PATENT DOCUMENTS

| | | | | |
|---|---|---|---|---|
| 7,559,114 | B2 | 7/2009 | Ranilovich | |
| 9,765,556 | B2 | 9/2017 | Stots | |
| 9,988,833 | B2 | 6/2018 | Powell | |
| 10,415,281 | B2 | 9/2019 | Enos et al. | |
| 10,900,267 | B2 | 1/2021 | Mikesell | |
| 11,149,484 | B1 * | 10/2021 | Bouzianis | E05F 5/02 |
| 11,473,354 | B2 * | 10/2022 | Maher | E05C 17/24 |
| 11,542,734 | B1 * | 1/2023 | Gunkler | E05C 17/02 |
| 11,629,537 | B2 | 4/2023 | Daniels | |
| 2011/0018287 | A1 | 1/2011 | Wise | |
| 2014/0375070 | A1 * | 12/2014 | Hatton | E05C 17/50 292/339 |
| 2015/0008684 | A1 | 1/2015 | Ching | |
| 2017/0335608 | A1 * | 11/2017 | Ching | E05C 19/184 |
| 2019/0226250 | A1 | 7/2019 | Pavlow | |
| 2020/0208447 | A1 | 7/2020 | Farkas | |
| 2021/0388654 | A1 | 12/2021 | Daniels | |

OTHER PUBLICATIONS

Daniels, William Bruce; Notice of Allowance for U.S. Appl. No. 17/345,653, filed Jun. 11, 2021, dated Dec. 16, 2022, 5 pgs.

* cited by examiner

DOOR LOCKING DEVICE

CROSS-REFERENCE TO RELATED APPLICATIONS

The present application is a continuation of U.S. application Ser. No. 17/345,653, filed Jun. 11, 2021, which claims the benefit of U.S. Provisional Application No. 63/102,385, filed Jun. 12, 2020, each of which is hereby specifically incorporated by reference herein in its entirety.

TECHNICAL FIELD

This disclosure relates to doors. More specifically, this disclosure relates to locking device mountable on a door hinge.

BACKGROUND

Locks for doors are sometimes employed to prevent unauthorized access through the door. Conventional locks often comprise piece of metal that slides out from the door and engages a surrounding door frame. However, if enough force is applied to the lock, the lock can fail or break, allowing the door to be opened, which can present a danger in situations where the door must be secured, such as a lockdown situation involving an unwelcome intruder. Additionally, even if the lock succeeds, the door's hinges (typically located on the opposite side of the door from the lock) can be broken if a suitable force is applied to the door.

SUMMARY

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts of the disclosure as an introduction to the following complete and extensive detailed description.

Disclosed is a hinge locking device for a door, the hinge locking device comprising a mounting plate defining an upper plate end and a lower plate end, a plate slot extending into the mounting plate at the lower plate end, the plate slot configured to receive a hinge plate of a door hinge assembly therethrough; a reinforcement gusset affixed to the mounting plate and defining a gusset recess aligned with the plate slot; and a barrel channel defined between the gusset recess and the mounting plate, the plate slot allowing lateral access to the barrel channel, the barrel channel configured to receive a hinge barrel of the door hinge assembly.

Also disclosed is a hinge locking assembly comprising a hinge locking device comprising a mounting plate and a plate slot, the mounting plate extending into the mounting plate at a lower plate end of the mounting plate; and a wall mount comprising a first mounting arm, a second mounting arm, and a mounting cross-member extending between the first and second mounting arms, wherein the first mounting arm defines a first mounting slot engaging the lower plate end of the mounting plate, and the second mounting arm defines a second mounting slot engaging the plate slot of the mounting plate.

A method of locking a door is also disclosed, the method comprising providing a hinge locking device comprising a mounting plate and defining a hinge slot and a barrel channel; sliding the hinge locking device onto a door hinge assembly of a door, wherein sliding the hinge locking device onto the door hinge assembly comprising engaging a hinge plate of the door hinge assembly with the hinge slot and engaging a hinge barrel of the door hinge assembly with the barrel channel; confronting a door panel of the door with a first plate section of the mounting plate; and confronting a door frame surrounding the door with a second plate section of the mounting plate.

Additionally, disclosed is a door locking device includes a mounting plate configured to be mounted to the door; a reinforcement gusset extending outward from the mounting plate, the reinforcement gusset defining an extension portion; and a wall engagement member adjustably affixed to the extension portion of the reinforcement gusset and laterally offset from the mounting plate; wherein the wall engagement member is movable relative to the extension portion in a direction substantially perpendicular to the mounting plate, wherein the extension portion configured to confront a wall adjacent to the door.

Also disclosed is a method of using a door locking device comprising mounting a mounting plate of the door locking device to a door, the door locking device further comprising a reinforcement gusset extending from the mounting plate and a wall engagement member adjustably affixed to the reinforcement gusset; moving the wall engagement member relative to the reinforcement gusset in a direction substantially perpendicular to the mounting plate; securing the wall engagement member in position relative to the reinforcement gusset; and confronting a wall surrounding the door with a wall engagement face of the wall engagement member.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1:
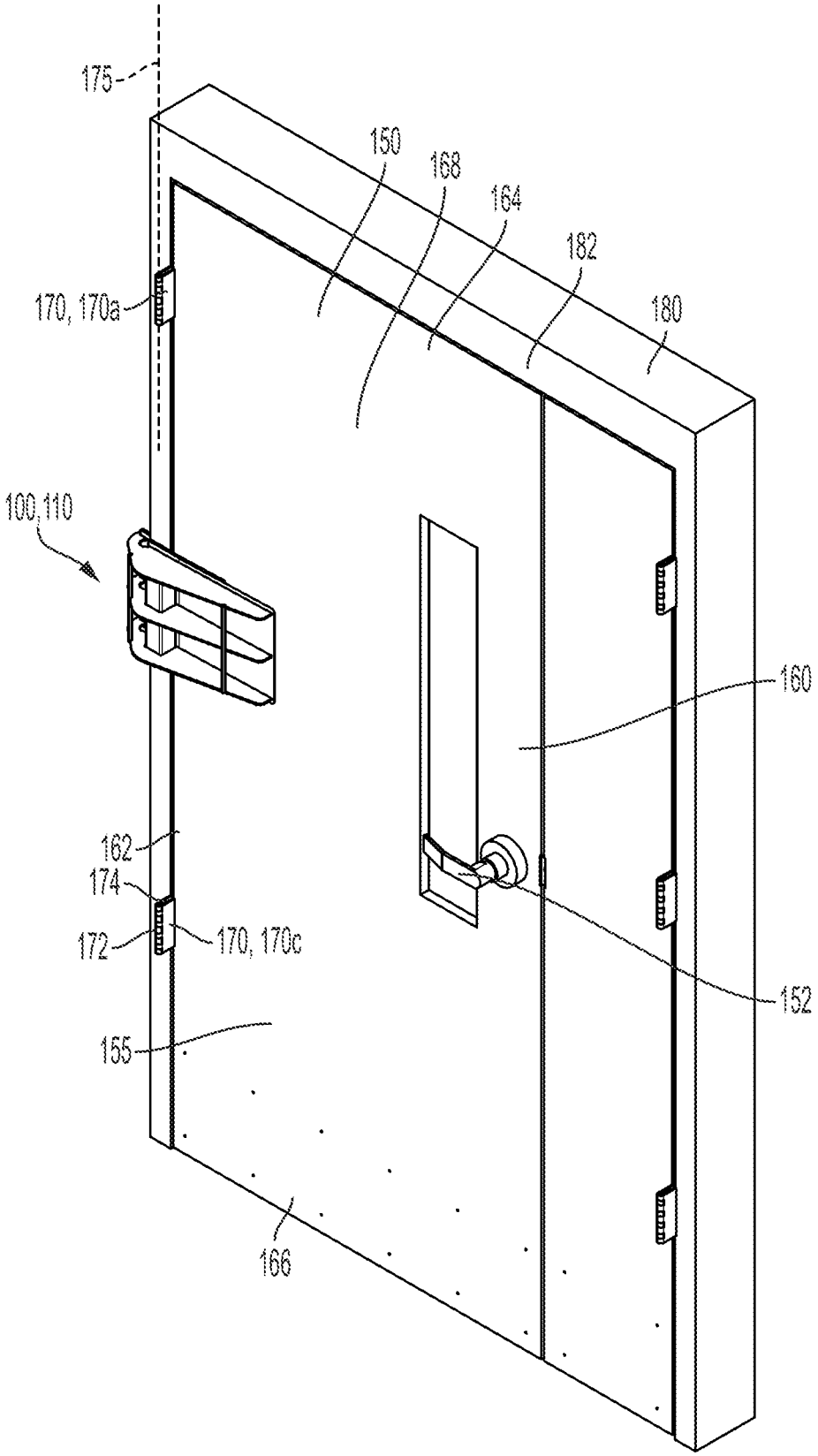
FIG. 1 is a front perspective view of a hinge locking device mounted on a door, in accordance with one aspect of the present disclosure.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutations of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed is a hinge locking device and associated methods, systems, devices, and various apparatus. Example aspects of the hinge locking device can comprise a mounting plate and a hinge slot. It would be understood by one of skill in the art that the hinge locking device is described in but a few exemplary embodiments among many. No particular terminology or description should be considered limiting on the disclosure or the scope of any claims issuing therefrom.

FIG. 1 is a perspective view of a hinge locking device 100 mounted on a door 150, in accordance with one aspect of the present disclosure. The hinge locking device 100 can be selectively mounted to the door 150 to lock and unlock the door 150 in a closed position as needed. For example, the hinge locking device 100 can be utilized in lockdown situations in buildings such as offices, schools, and government facilities, wherein a person inside of a room wishes to reinforce the door 150 from the inside. Example aspects of the door 150 can comprise a door panel 155 defining a first door side 160, a second door side 162 opposite the first door side 160, a top door end 164, and a bottom door end 166 opposite the top door end 164. The door panel 155 can further define a door front face 168 and door rear face (not shown) opposite the door front face 168. In example aspects, one or more door hinge assemblies 170 can be coupled to the door panel 155 at the second door side 162 thereof. The door hinge assemblies 170 can be configured to pivotably mount the door 150 to a door frame 180, which can be defined by or coupled to a wall 1190 (shown in FIG. 11) or other surrounding structure. The door frame 180 can define a frame front face 182, which can face substantially the same direction as the door front face 168 of the door panel 155. In the present aspect, three of the door hinge assemblies 170*a,b,c* (door hinge assembly 170*b* shown in FIG. 2) can pivotably mount the door 150 to the door frame 180. As shown, each of the door hinge assemblies 170 can extend outwardly from the door front face 168 and can comprise a hinge barrel 172 that can be accessible to the user when the door 150 is in the closed position, as shown. Each of the hinge barrels 172 can be oriented substantially vertically, relative to the orientation shown, and can define a substantially vertical pivot axis 175 about which the door 150 can pivot.

According to example aspects, the hinge locking device 100 can be selectively mounted on one of the door hinge assemblies 170 by a user. For example, the hinge locking device 100 of the present aspect can be a slide-on style hinge locking device 100, which can be slid onto a corresponding hinge barrel 172 over an upper hinge end 174 of the corresponding door hinge assembly 170. In the present aspect, the door 150 can be opened towards the door front face 168. Thus, the hinge barrels 172 can be positioned on the side of the door 150 towards which the door 150 opens. In some aspects, a door handle 152 or door knob can be coupled to the door panel 155 proximate to the first door side 160, which can be gripped by a user to pivot the door 150 relative to the door frame 180. According to example aspects, the hinge locking device 100 can be configured to engage the frame front face 182 and the door front face 168 surrounding the corresponding hinge barrel 172 to prohibit the door 150 from opening, as described in further detail below. In some aspects, the hinge locking device 100 can also engage the surrounding wall 1190. The hinge locking device 100 can comprise a locking device body 110, as shown and described in further detail below.

Figure 2:
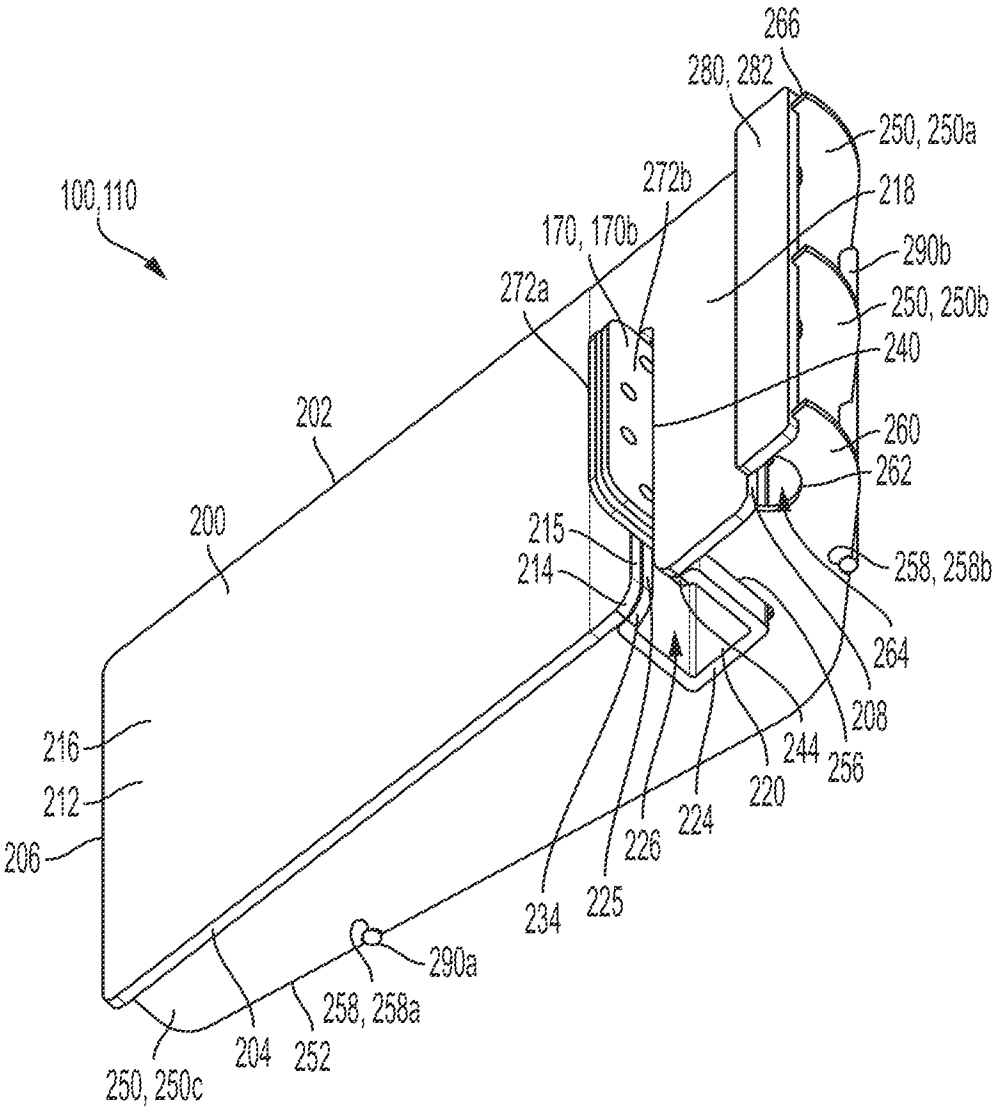
FIG. 2 is a rear perspective view of the hinge locking device of FIG. 1.

FIG. 2 illustrates a rear perspective view of the hinge locking device 100 mounted on the corresponding door hinge assembly 170*b*. Example aspects of the hinge locking device 100 can be constructed of a durable material that can be strong enough to withstand forces applied to the door 150 when an attempt to open the door 150 is made, in order to retain the door 150 in the closed position against would-be intruders, for example and without limitation, steel. In some aspects, various components of the hinge locking device 100 can be formed from heavy-duty, laser-cut, stamped, and/or otherwise machined steel or other durable metal. In other aspects, some or all of the components of the hinge locking device 100 can comprise any other suitable material or combination of materials that are strong enough to retain the door 150 in the closed position, including other metals, plastics, composites, and the like. The locking device body 110 of the hinge locking device 100 can comprise a mounting plate 200 and a slotted member, such as a slotted tubing 220, affixed to the mounting plate 200. Example aspects of mounting plate 200 can be substantially planar and can be substantially rectangular in shape. The mounting plate 200 can define an upper plate end 202, a lower plate end 204, a first plate side 206, and a second plate side 208. The mounting plate 200 can further define a front plate face 310 (shown in FIG. 3) and a rear plate face 212. The tubing 220 can be affixed to the front plate face 310 of the mounting plate 200. Example aspects of the tubing 220 can define the shape of a rectangular prism with a square cross-section. In other aspects, the mounting plate 200 and/or the tubing 220 can define any other suitable shape. The tubing 220 can define an upper end 322 (shown in FIG. 3) and a lower end 224, and a barrel channel 226 can extend through the tubing 220 from the upper end 322 to the lower end 224. Each of the upper end 322 and lower end 224 can be open, permitting access to the barrel channel 226.

According to example aspects, the mounting plate 200 can define a plate slot 215 extending into the mounting plate 200 from the lower plate end 204 thereof, and similarly, the slotted tubing 220 can define a slotted member slot, such as a tubing slot 225, extending into a rear side 332 (shown in FIG. 3) of the tubing 220 from the lower end 224 thereof. In some aspects, the lower plate end 204 can be substantially flush with the lower end 224. The plate slot 215 and the tubing slot 225 can be laterally aligned, relative to the orientation shown, and can together define a hinge slot 240 of the hinge locking device 100. The hinge slot 240 can allow lateral access to the barrel channel 226 of the tubing 220. As shown, each of the plate slot 215 and the tubing slot 225 can terminate at an upper slot end 442 (shown in FIG. 4) of the hinge slot 240. Other aspects of the hinge locking device 100 may not comprise the tubing 220, and the hinge slot 240 can be defined by the plate slot 215 only.

According to example aspects, the transitions between the lower plate end 204 and the plate slot 215 can define plate fillets 214 or plate chamfers 1314 (shown in FIG. 13), and the transitions between the lower end 224 and the tubing slot 225 can define tubing fillets 234 or tubing chamfers, such that a lower slot opening 244 of the hinge slot 240 can be filleted or chamfered. Thus, a width of the hinge slot 240 at the lower slot opening 244 can be greater than a width of the hinge slot 240 at the upper slot end 442. However, in other aspects, the transitions may not be filleted or chamfered. The plate slot 215 and the tubing slot 225 can be about equal in width and length; however, in other aspects, the plate slot 215 and the tubing slot 225 can differ in width and/or length.

In example aspects, the plate slot 215 can be formed in the mounting plate 200 proximate to the second plate side 208 thereof. The mounting plate 200 can define a first plate section 216 extending from the first plate side 206 to the plate slot 215 and a second plate section 218 extending from the second plate side 208 to the plate slot 215. According to example aspects, the first plate section 216 can define a length that can be greater than a length of the second plate section 218. The first plate section 216 can be configured to confront and brace against the door front face 168 (shown in FIG. 1) adjacent to the door hinge assembly 170*b*, and the second plate section 218 can be configured to confront and brace against the frame front face 182 of the door frame 180 (shown in FIG. 1) adjacent to the door hinge assembly 170*b*.

The locking device body 110 of the hinge locking device 100 can further comprise one or more reinforcement gussets 250 that can be affixed to the mounting plate 200 and/or the tubing 220. For example, the hinge locking device 100 can comprise upper, middle, and lower reinforcement gussets 250*a,b,c*, which can be affixed to the front plate face 310 of the mounting plate 200. Other aspects of the hinge locking device 100 can define more or fewer of the reinforcement gussets 250. As shown, the reinforcement gussets 250 can be oriented about perpendicular to the mounting plate 200. The reinforcement gussets 250 can generally define a triangular or rhomboidal shape, or can define any other suitable shape in other aspects. The reinforcement gussets 250 can each define a front gusset edge 252 and a rear gusset edge 354 (shown in FIG. 3). The rear gusset edge 354 can abut and be affixed to the front plate face 310 of the mounting plate 200 in some aspects. As shown, some or all of the reinforcement gussets 250 can define a gusset recess 256 extending into the rear gusset edge 354. In the present aspects, the reinforcement gussets 250*b,c* can define the gusset recess 256, while the reinforcement gusset 250*a* does not define the gusset recess 256. The gusset recesses 256 can be substantially square in shape to conform to the square cross-sectional shape of the tubing 220. When the reinforcement gussets 250 are assembled with the mounting plate 200 and the tubing 220, the gusset recesses 256 can be vertically aligned, relative to the orientation shown, and the tubing 220 can extend through each of the gusset recesses 256. Thus, the barrel channel 226 formed by the tubing 220 can be defined between the gusset recesses 256 and the front plate face 310 of the mounting plate 200.

Figure 13:
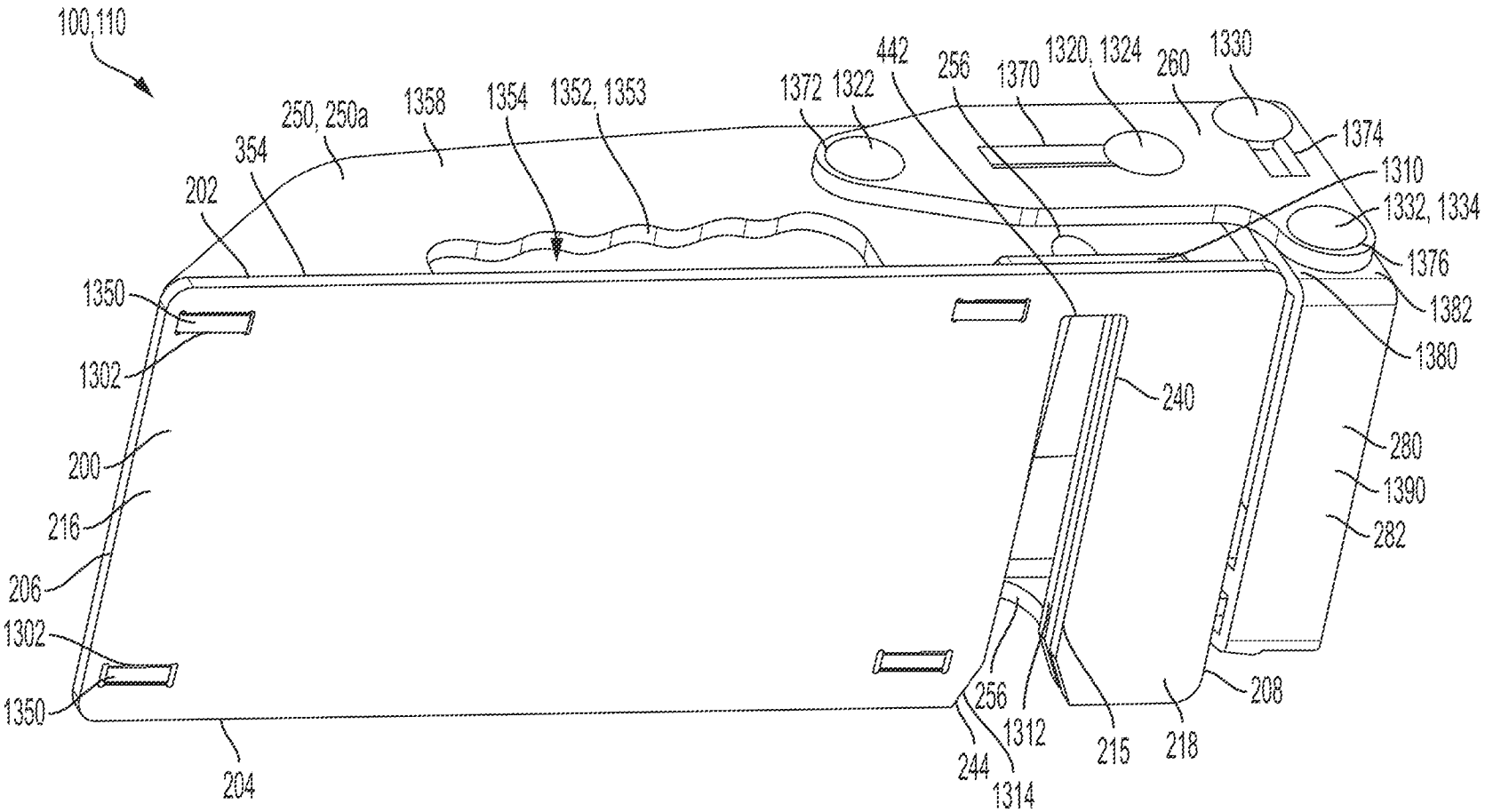
FIG. 13 is a rear perspective view of the hinge locking device, in accordance with one aspect of the present disclosure.

According to example aspects, each of the reinforcement gussets 250 can define an extension portion 260 extending laterally beyond the second plate side 208 of the mounting plate 200. The extension portion 260 can be monolithically formed (i.e., formed a singular component that constitutes a single material without joints or seams) with the corresponding reinforcement gusset 250 in the present aspect; however, in other aspects, the extension portion 260 can be formed separately from the reinforcement gusset 250, as shown in FIG. 13. Each of the extension portions 260 can define an arcuate recess 262 extending into the rear gusset edge 354 of the reinforcement gusset 250, adjacent to the second plate side 208 of the mounting plate 200. For example, each of the arcuate recesses 262 can define the arc of a circle, and in the present aspect, each of the arcuate recesses 262 can define a major arc (i.e., an arc greater than a semi-circle.) When the reinforcement gussets 250 are assembled with the mounting plate 200, the arcuate recesses 262 can be substantially coaxial and can define a frame channel 264 of the hinge locking device 100. In example aspects, when the hinge locking device 100 is mounted to the corresponding door hinge assembly 170, the frame channel 264 can receive a portion of the door frame 180.

According to example aspects, a wall engagement member 280 can be affixed to each of the extension portions 260 at the corresponding rear gusset edge 354. The wall engagement member 280 can be positioned proximate to the arcuate recesses 262, opposite the second plate side 208 of the mounting plate 200. Example aspects of the wall engagement member 280 can be substantially planar and rectangular in shape. Furthermore, the wall engagement member 280 can be substantially parallel with the mounting plate 200. In some aspects, the extension portions 260 can wrap around the second plate side 208 of the mounting plate 200 and a distal end 266 each extension portion 260 can extend beyond the rear plate face 212 of the mounting plate 200. The wall engagement member 280 can be affixed to the extension portions 260 at the distal ends 266 thereof, thereby offsetting the wall engagement member 280 from the plane in which the mounting plate 200 lies. In other aspects, the wall engagement member 280 can be coplanar with the mounting plate 200. According to example aspects, the extension portions 260 of the reinforcement gussets 250 can be configured to wrap around an outer frame edge 1082 (shown in FIG. 12) of the door frame 180, and a wall engagement face 282 of the wall engagement member 280 can confront the surrounding wall 1190 (shown in FIG. 11) to brace the hinge locking device 100 against the wall 1190. In other aspects, the extension portions 260 and the wall engagement member 280 can define any suitable shape or configuration to adapt to door frames 180 and walls 1190 of varying configurations. Other aspects of the hinge locking device 100 may not comprise the extension portions 260 and the wall engagement member 280, and the hinge locking device 100 can be configured to confront the door panel 155 and the door frame 180 only.

In example aspects, each of the reinforcement gussets 250 can further define one or more rod recesses 258 extending into the front gusset edge 252 thereof. For example, as shown, each of the reinforcement gussets 250 can define a first rod recess 258*a* and a second rod recess 258*b*. The hinge locking device 100 can comprise a first handle rod 290*a* engaging each of the first rod recesses 258*a* and affixed to the reinforcement gussets 250 distal to the mounting plate 200. The hinge locking device 100 can further comprise a second handle rod 290*b* engaging each of the second rod recesses 258*b* and affixed to the reinforcement gussets 250 distal to the mounting plate 200. As shown, the first and second handle rods 290*a,b* can be oriented substantially parallel to the mounting plate 200 and substantially perpendicular to the reinforcement gussets 250. The first and second handle rods 290*a,b* can be configured to reinforce and connect the reinforcement gussets 250 at the front gusset edges 252 thereof. Additionally, the first and second handle rods 290*a,b* can be gripped by a user to facilitate handling the hinge locking device 100 when mounting and removing the hinge locking device 100 to and from the corresponding door hinge assembly 170. Other aspects of the hinge locking device 100 can include more or fewer handle rods. In the present aspect, the rod recesses 258 can be substantially semi-circular and the first and second handle rods 290*a,b* can define a substantially cylindrical shape. However, in other aspects, the rod recesses 258 and the first and second handle rods 290*a,b* can define any other suitable shape.

The hinge locking device 100 can be mounted on the corresponding door hinge assembly 170*b*, as shown. The door hinge assembly 170*b* can define the upper hinge end 174. Example aspects of the door hinge assembly 170*b* can comprise a pair of hinge plates 272*a,b*, which can be coupled to the door panel 155 and the door frame 180, respectively. The hinge plates 272*a,b* can be pivotably coupled together at the corresponding hinge barrel 172 (shown in FIG. 1). When the door 150 is closed, the hinge plates 272*a,b* can be sandwiched between the door panel 155 and the door frame 180, and can confront and be oriented substantially parallel to one another. According to example aspects, the hinge locking device 100 can be mounted on the door hinge assembly 170*b* when the door 150 is closed. To mount the hinge locking device 100 on the door hinge assembly 170*b*, the barrel channel 226 can be vertically aligned over the hinge barrel 172 and the hinge slot 240 can be vertically aligned over the hinge plates 272*a,b*. The hinge locking device 100 can then be lowered onto the door hinge assembly 170*b* over the upper hinge end 174, with the hinge barrel 172 engaging the barrel channel 226 and the hinge plates 272*a,b* extending through the hinge slot 240. In example aspects, the plate fillets 214 and the tubing fillets 234 can facilitate guiding the hinge plates 272*a,b* into the hinge slot 240. The hinge locking device 100 can be slid down onto the door hinge assembly 170*b* until the upper hinge end 174 abuts the upper slot end 442 of the hinge slot 240, and the hinge locking device 100 can rest on the door hinge assembly 170*b*.

Figure 3:
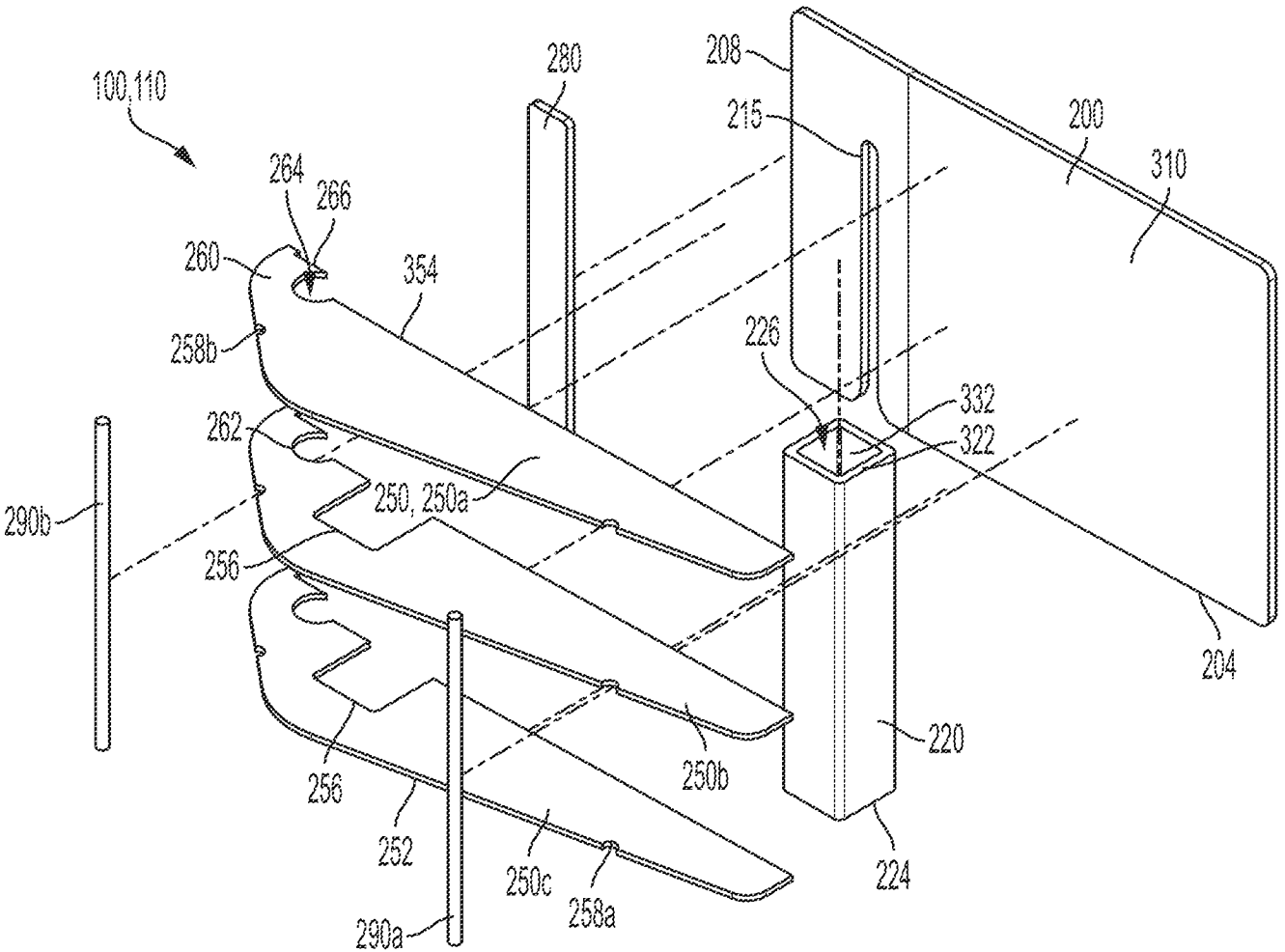
FIG. 3 is an exploded view of the hinge locking device of FIG. 1.

FIG. 3 illustrates an exploded view of the hinge locking device 100. As shown, the hinge locking device 100 can comprise the mounting plate 200, the tubing 220, the three reinforcement gussets 250, the wall engagement member 280, and the first and second handle rods 290*a,b*. The mounting plate 200 can define the front plate face 310 and the rear plate face 212 (shown in FIG. 2). The plate slot 215 can extend into the mounting plate 200 at the lower plate end 204. The tubing 220 can define an upper end 322, the lower end 224, and the barrel channel 226 can extend therethrough. The tubing slot 225 (shown in FIG. 2) can extend into the rear side 332 of the tubing 220 at the lower end 224. Each of the reinforcement gussets 250 can define the front gusset edge 252 and the rear gusset edge 354. One of the gusset recesses 256 can extend into the rear gusset edge 354 of each of the reinforcement gussets 250*b,c*, and the gusset recesses 256 can be configured to receive the tubing 220 therethrough. The reinforcement gusset 250*a* does not define one of the gusset recesses 256 and can be configured to cover the open upper end 322 when the hinge locking device 100 is assembled. Each of the reinforcement gussets 250 can further define one of the first rod recesses 258*a* and one of the second rod recesses 258*b*. The first handle rod 290*a* can engage the first rod recesses 258*a* and the second handle rod 290*b* can engage the second rod recesses 258*b*. Each of the reinforcement gussets 250 can further define the extension portion 260, which can extend laterally beyond the second plate side 208 of the mounting plate 200. Each of the extension portions 260 can define one of the arcuate recesses 262 extending into the rear gusset edge 354. The arcuate recesses 262 can be vertically aligned and can together define the frame channel 264. Furthermore, the wall engagement member 280 can be provided. Each of the rear gusset edges 354 can define a distal end 266 of the corresponding extension portion 260, and the wall engagement member 280 can be affixed to the distal ends 266. The wall engagement member 280 can be substantially parallel with the mounting plate 200.

Figure 4:
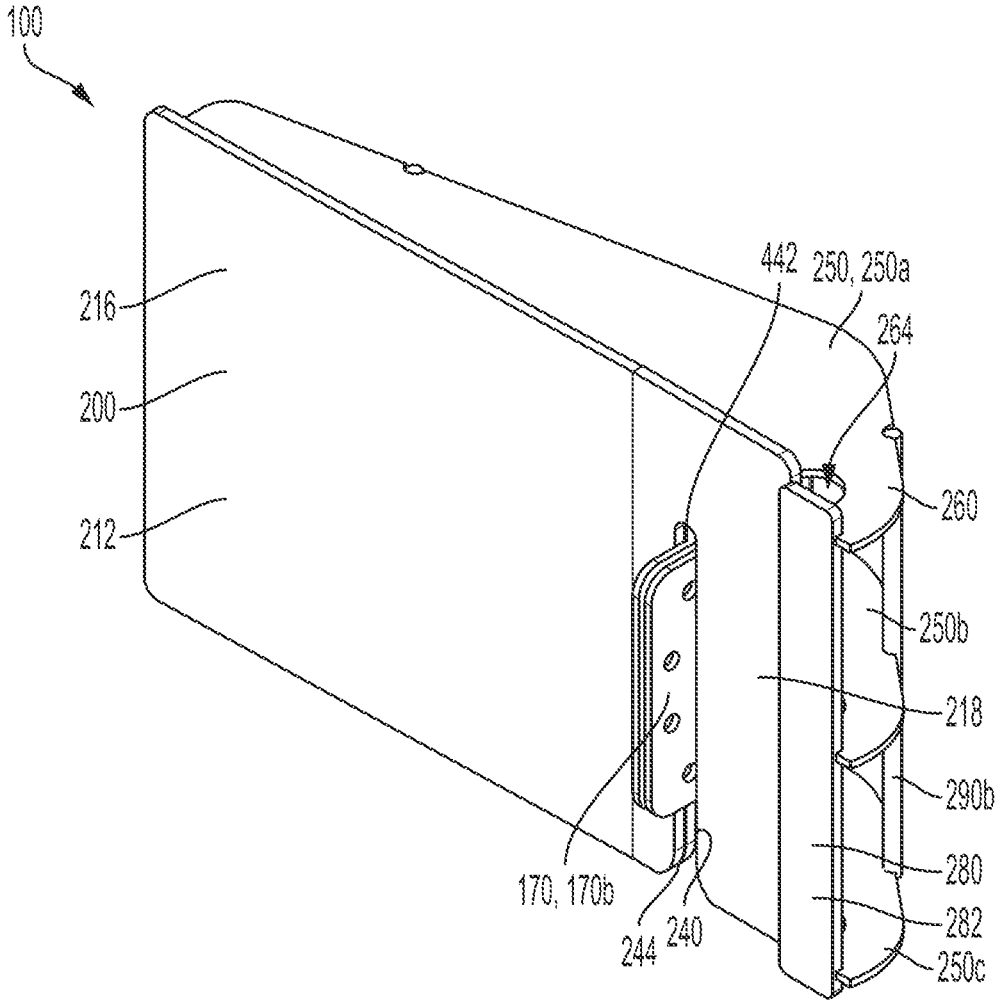
FIG. 4 is another rear perspective view of the hinge locking device of FIG. 1.
Figure 5:
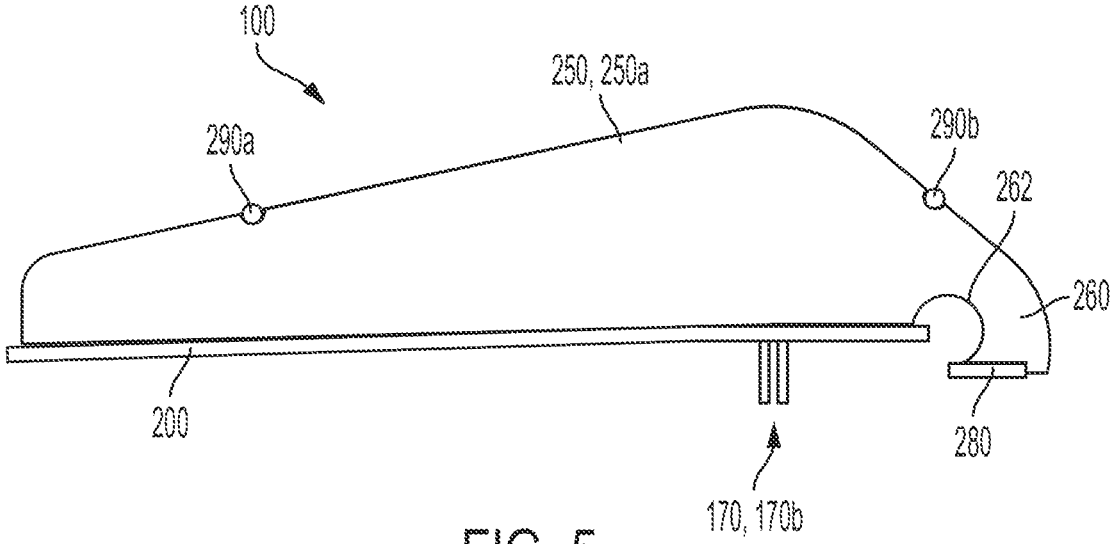
FIG. 5 is a top view of the hinge locking device of FIG. 1.
Figure 6:
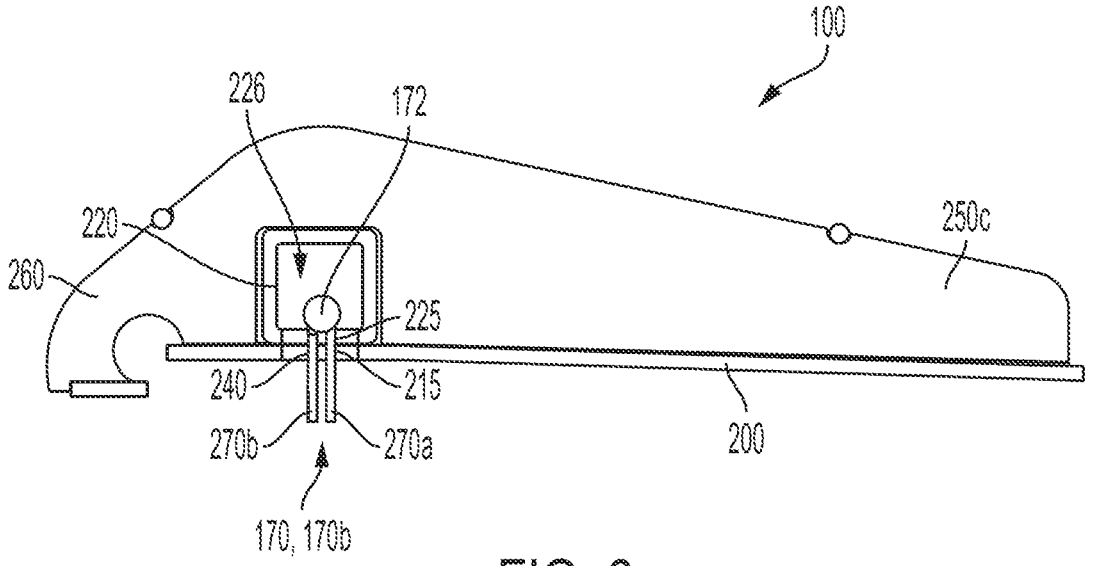
FIG. 6 is a bottom view of the hinge locking device of FIG. 1.
Figure 7:
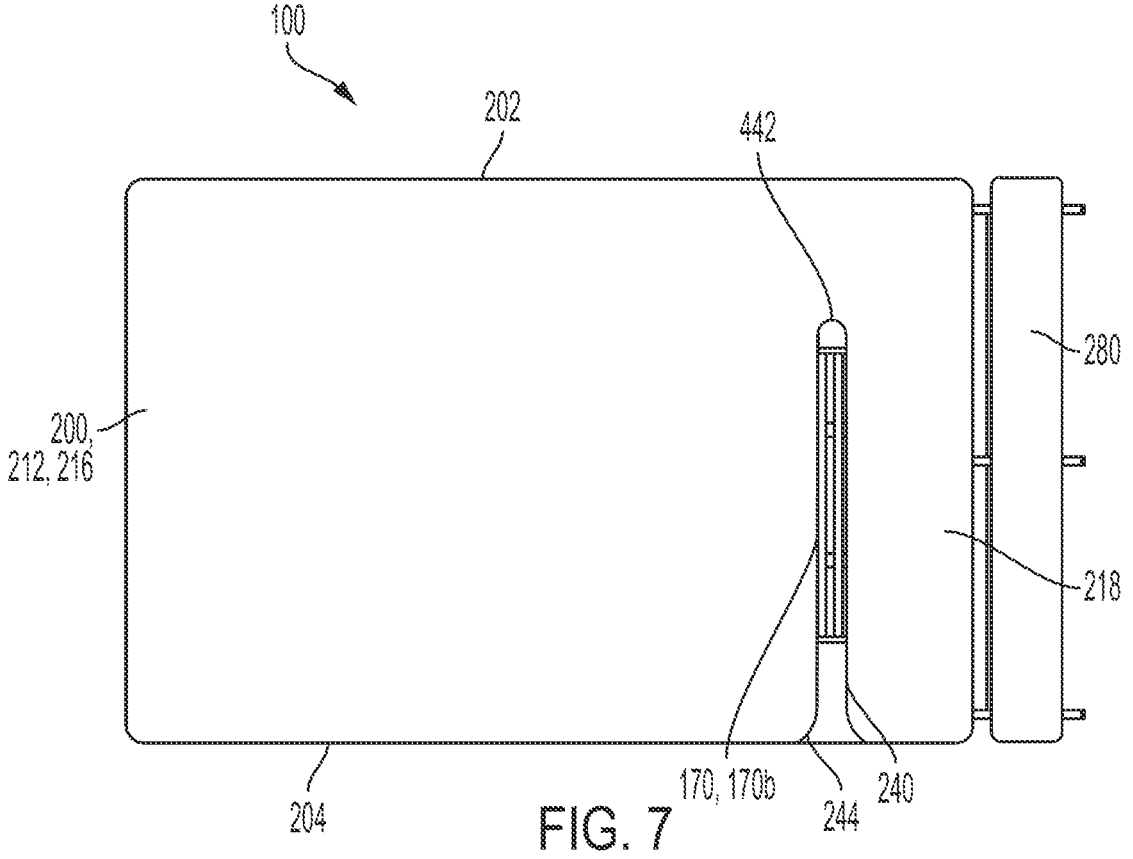
FIG. 7 is a rear view of the hinge locking device of FIG. 1
Figure 8:
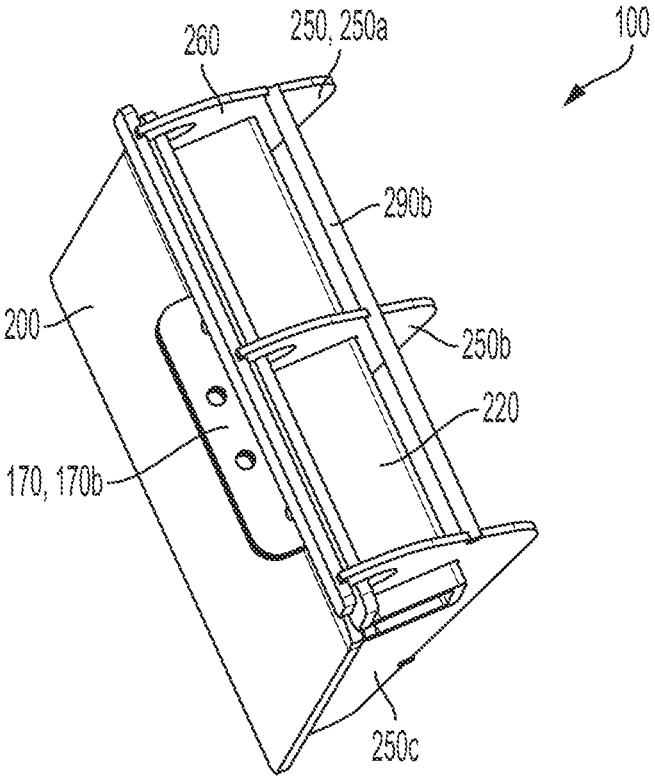
FIG. 8 is a side perspective view of the hinge locking device of FIG. 1.
Figure 9:
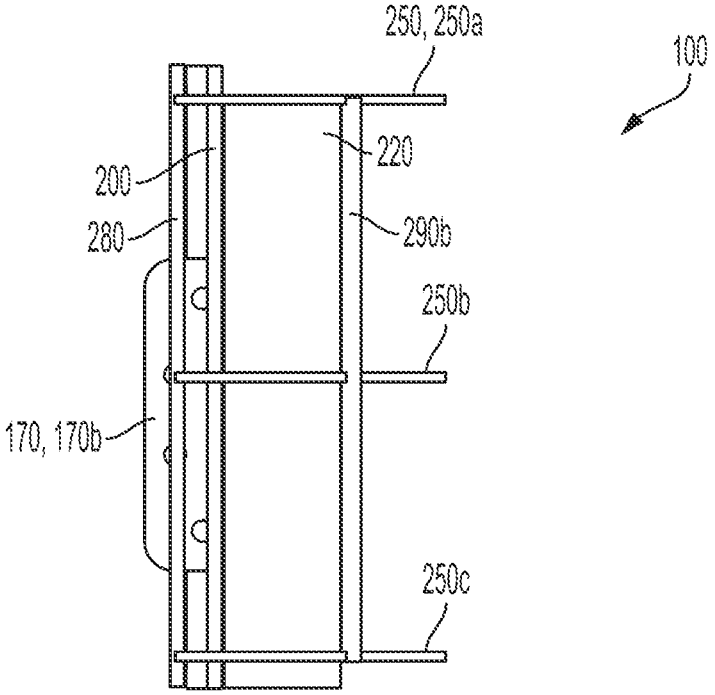
FIG. 9 is a side view of the hinge locking device of FIG. 1.

FIGS. 4-9 illustrate various additional views of the hinge locking device 100 mounted on the corresponding door hinge assembly 170*b*. FIG. 4 is a rear perspective view, FIG. 5 is top view, FIG. 6 is a bottom view, FIG. 7 is a rear view, FIG. 8 is a side perspective view, and FIG. 9 is a side view. FIG. 6 best illustrates the door hinge assembly 170*b* engaging the hinge locking device 100. As shown, each of the hinge plates 272*a,b* of the door hinge assembly 170*b* can extend through the hinge slot 240, which can be defined by the plate slot 215 of the mounting plate 200 and the tubing slot 225 of the tubing 220. Additionally, the hinge barrel 172 of the door hinge assembly 170*b* can be received in the barrel channel 226 defined by the tubing 220.

Figure 10:
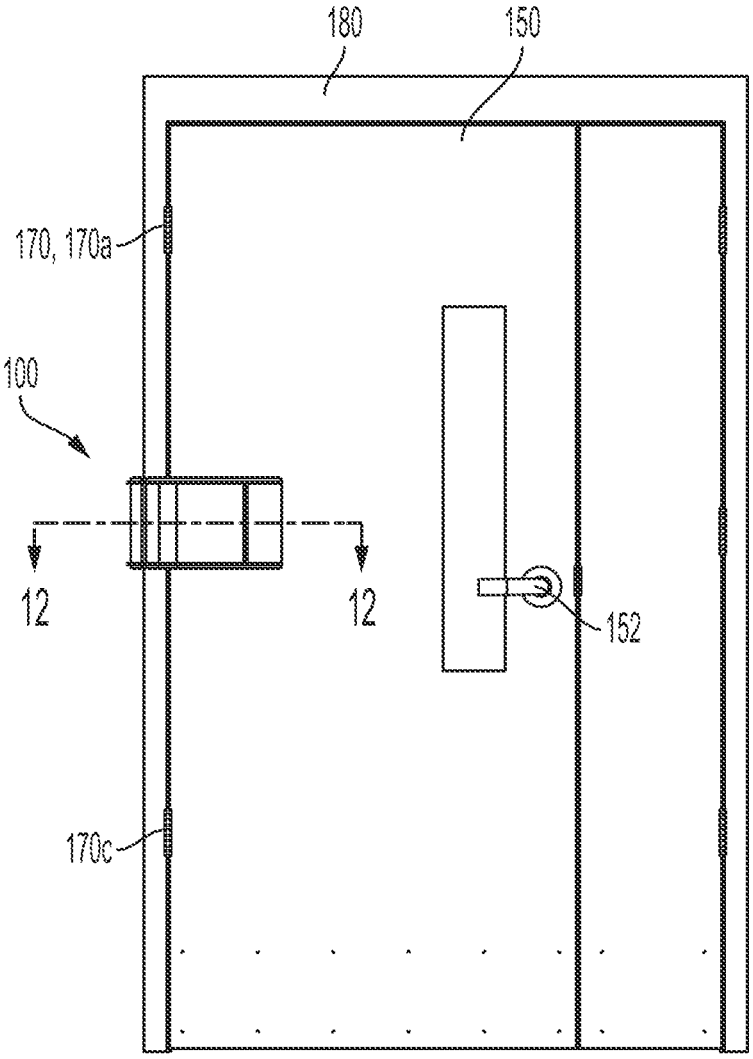
FIG. 10 is a front view of the hinge locking device of FIG. 1 mounted on the door of FIG. 1.
Figure 11:
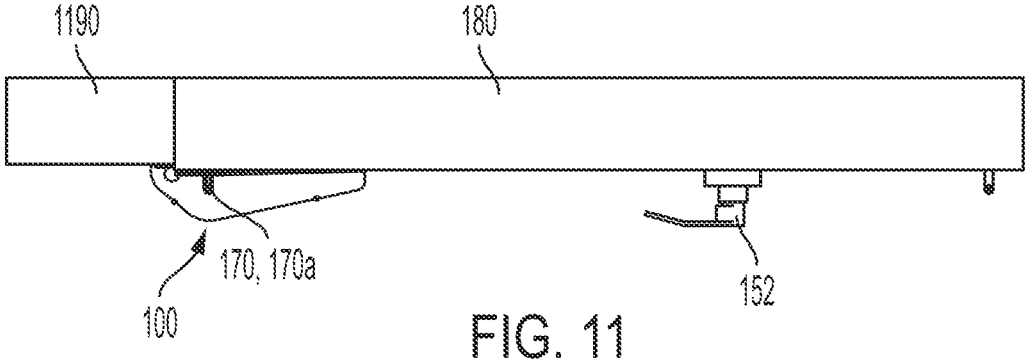
FIG. 11 is a top view of the hinge locking device of FIG. 1 mounted on the door of FIG. 1.
Figure 12:
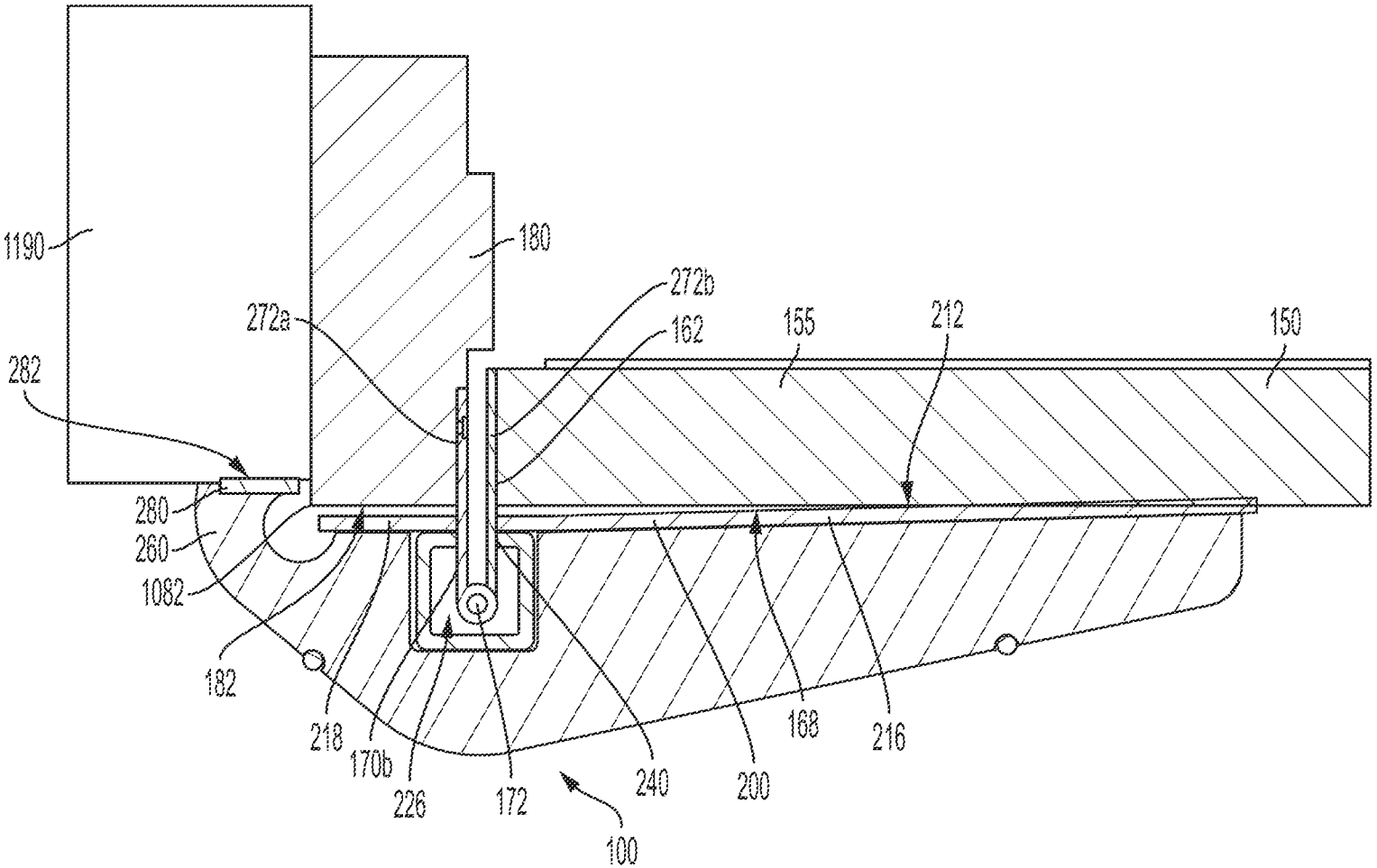
FIG. 12 is a cross-sectional view of the hinge locking device of FIG. 1 mounted on the door of FIG. 1, taken along line 12-12 in FIG. 10.

FIGS. 10-12 illustrate front, top, and cross-sectional views, respectively, of the hinge locking device 100 mounted to a corresponding one of the door hinge assemblies 170 to lock the door 150 in the closed position. In the present aspect, the hinge locking device 100 can be mounted to the door hinge assembly 170*b* (shown in FIG. 12), but in other aspects, the hinge locking device 100 can be mounted to any of the other door hinge assemblies 170*a,c*. According to example aspects, the hinge locking device 100 can engage the door panel 155, the door frame 180, and the wall 1190 (shown in FIG. 11) to lock the door 150 in the closed position, as described in further detail below.

Referring to FIG. 12, as shown, the hinge plates 272*a,b* of the door hinge assembly 170*b* can be sandwiched between and coupled to the second door side 162 of the door panel 155 and the door frame 180, respectively. The hinge plates 272*a,b* can extend outwardly beyond the door front face 168 of the door panel 155, and can be pivotably coupled together at the hinge barrel 172. The hinge plates 272*a,b* can extend through the hinge slot 240 of the hinge locking device 100, and the hinge barrel 172 can be received within the barrel channel 226 of the hinge locking device 100. As described above, the upper slot end 442 (shown in FIG. 4) of the hinge slot 240 can rest on the upper hinge end 174 (shown in FIG. 1) of the hinge plates 272*a,b* to mount the hinge locking device 100 on the door hinge assembly 170*b*.

The rear plate face 212 of the mounting plate 200 can confront, and in some instances can abut, the door panel 155 and the door frame 180. Specifically, in the present aspect, the first plate section 216 of the mounting plate 200 can confront and abut the door front face 168 of the door panel 155, and the second plate section 218 of the mounting plate 200 can confront the frame front face 182 of the door frame 180. In some aspects, the engagement of the mounting plate 200 with the door frame 180 and the door panel 155 can be suitable to secure the door 150 in the closed position. Additionally, in some aspects, the first plate section 216 of the mounting plate 200 can dig into the door front face 168 if an attempt to open the door 150 is made. In aspects of the hinge locking device 100 comprising the extension portions 260 and the wall engagement member 280 attached thereto, the wall engagement member 280 can confront, and in some instances can abut, the wall 1190 surrounding the door frame 180. Specifically, as shown, the extension portion 260 of each of the reinforcement gussets 250 can wrap around the outer frame edge 1082 of the door frame 180, and the wall engagement face 282 of the wall engagement member 280 can confront and abut the wall 1190. The engagement of the hinge locking device 100 with the door panel 155, door frame 180, and wall 1190 can secure the door 150 in the closed position by preventing the door panel 155 from pivoting towards the hinge locking device 100. In other aspects, the hinge locking device 100 can define any other suitable configuration to adapt to doors 150, door frames 180, and/or walls 1190 of varying configurations. Furthermore, various components of the hinge locking device 100 can be resized or shaped according to accommodate other considerations, such as material savings and the like.

Figure 14:
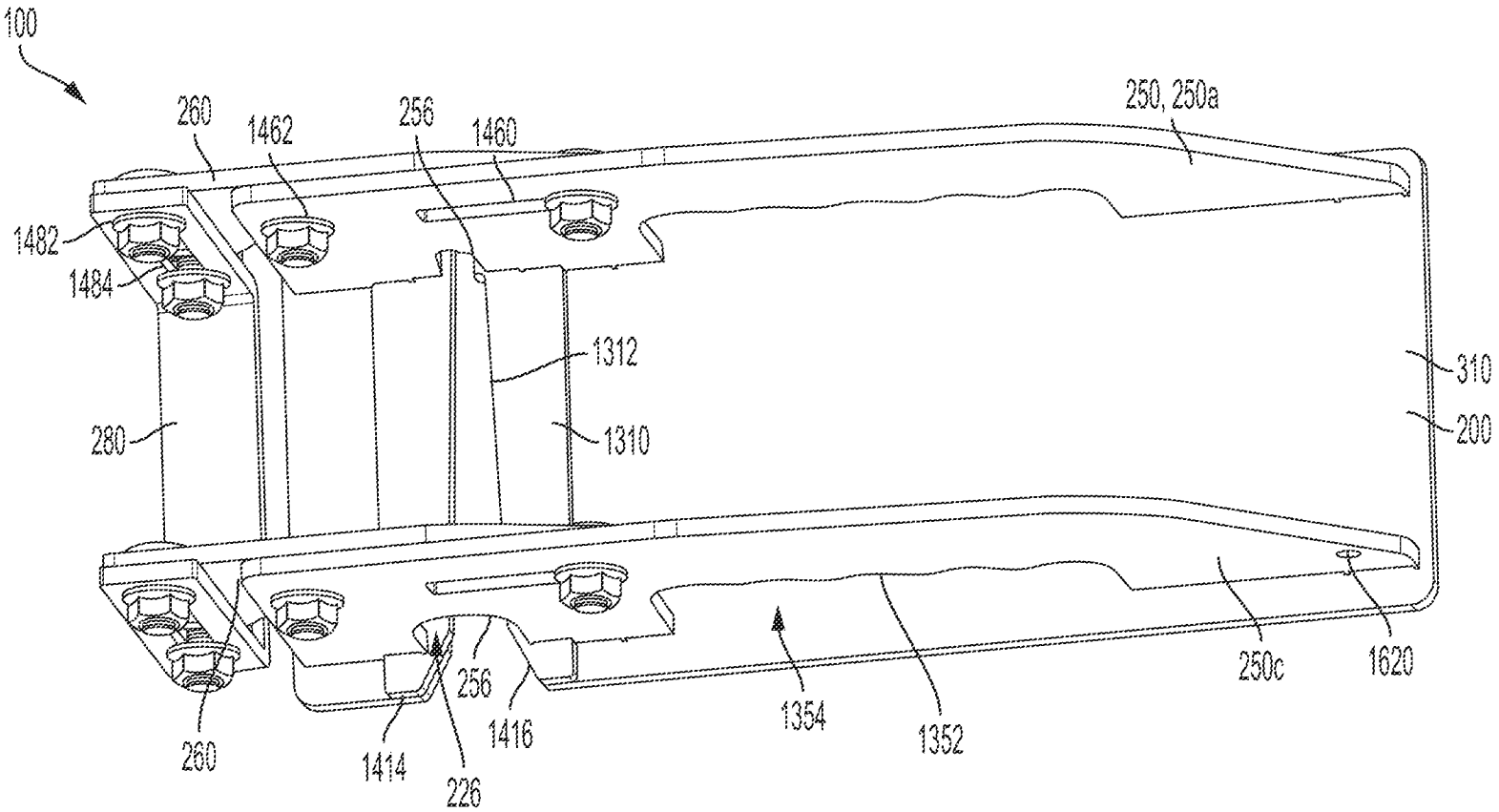
FIG. 14 is a front perspective view of the hinge locking device of FIG. 13.

FIGS. 13 and 14 illustrate the hinge locking device 100, in accordance with another aspect of the present disclosure. FIG. 13 illustrates a rear perspective view, and FIG. 14 illustrates a front perspective view. Referring to FIG. 13, as shown, the hinge locking device 100 can comprise the locking device body 110. The locking device body 110 can comprise the mounting plate 200. The mounting plate 200 can define the plate slot 215 extending into the mounting plate 200 at the lower plate end 204. The mounting plate 200 can further define the first plate section 216 extending from the first plate side 206 to the plate slot 215 and the second plate section 218 extending from the second plate side 208 to the plate slot 215. In the present aspect, instead of the slotted tubing 220 (shown in FIG. 2), the slotted member of the locking device body 110 can be a slotted reinforcement plate 1310 that can confront the front plate face 310 (shown in FIG. 14) of the mounting plate 200. The reinforcement plate 1310 can define the slotted member slot, which can be a reinforcement slot 1312 in the present aspect. The plate slot 215 and the reinforcement slot 1312 can together define the hinge slot 240 of the hinge locking device 100. Other aspects of the hinge locking device 100 may not comprise the reinforcement plate 1310, and the hinge slot 240 can be defined by the plate slot 215 only. According to example aspects, the transitions between the plate slot 215 and lower plate end 204 can define the plate chamfers 1314, and the transitions between the reinforcement slot 1312 and a lower reinforcement end 1414 (shown in FIG. 14) of the reinforcement plate 1310 can define reinforcement chamfers 1416 (shown in FIG. 14). Thus, the width of the hinge slot 240 at the lower slot opening 244 can be greater than the width of the hinge slot 240 at the upper slot end 442.

The locking device body 110 can further comprise one or more of the reinforcement gussets 250. In the present aspect, the hinge locking device 100 can comprise a pair of the reinforcement gussets 250. The upper reinforcement gusset 250*a* can be affixed to the mounting plate 200 proximate to the upper plate end 202, and the lower reinforcement gusset 250*c* (shown in FIG. 14) can be affixed to the mounting plate 200 proximate to the lower plate end 204. In the present aspect, each of the reinforcement gussets 250 can comprise a pair of connector tabs 1350 configured to engage a corresponding pair of connector openings 1302 formed in the mounting plate 200 to couple the reinforcement gussets 250 to the mounting plate 200. Furthermore, in place of the handle rods 290*a,b* (shown in FIG. 2), each of the reinforcement gussets 250 can define a gripping recess 1352. Each of the gripping recesses 1352 can extend into the corresponding reinforcement gusset 250 at the rear gusset edge 354, such that a handle opening 1354 can be defined between the front plate face 310 (shown in FIG. 14) of the mounting plate 200 and the gripping recess 1352. A user can extend a hand into each of the handle openings 1354 and can grip the corresponding gripping recess 1352 to facilitate handling the hinge locking device 100 when mounting and removing the hinge locking device 100 to and the corresponding door hinge assembly 170*b* (shown in FIG. 16). In some aspects, the gripping recesses 1352 can define an undulating profile 1353, as shown, or any other suitable complex profile. The undulating profile 1353 can enable the user to securely grip the gripping recesses 1352. In other aspects, however, the gripping recesses 1352 can define a simple profile, such as a linear or curved profile. Furthermore, in example aspects, each of the reinforcement gussets 250 can further define a gusset recess 256. The gusset recess 256 can extend into the corresponding reinforcement gusset 250 at the rear gusset edge 354, and can be aligned with the hinge slot 240, as shown. Thus, the barrel channel 226 (shown in FIG. 14) of the hinge locking device 100 can be defined between the gusset recesses 256 and the mounting plate 200. In some aspects, a width the gusset recess 256 of the upper reinforcement gusset 250*a* can be less than a width of the gusset recess 256 of the lower reinforcement gusset 250*c*, as shown in FIG. 14. The larger width of the gusset recess 256 of the lower reinforcement gusset 250*c* can allow for easy insertion of the hinge barrel 172 therethrough, while the smaller width of the gusset recess 256 of the upper reinforcement gusset 250*a* can tightly hold the hinge barrel 172 when the hinge locking device 100 is mounted on the door hinge assembly 170. Example aspects of the hinge locking device 100 can further define a device clip opening 1620 formed therethrough. For example, in the present aspect, the device clip opening 1620 can be formed through the lower reinforcement gusset 250*c*. The device clip opening 1620 is discussed in further detail below with respect to FIG. 16.

The hinge locking device 100 can further comprise the extension portions 260. However, in the present aspect, the extension portions 260 can be formed separately from the reinforcement gussets 250 and attached thereto. In example aspects, each of the extension portions 260 can overlap and be coupled to an upper gusset face 1358 of the corresponding reinforcement gusset 250. Each of the extension portions 260 can be oriented substantially parallel to the corresponding reinforcement gusset 250, and can extend beyond the second plate side 208 of the mounting plate 200, as described above. In some aspects, the extension portions 260 can be laterally adjustable relative to the corresponding reinforcement gusset 250. Each of the reinforcement gussets 250 can define a gusset adjustment slot 1460 (shown in FIG. 14) and a gusset fastener hole 1462 (shown in FIG. 14) formed therethrough. Each of the extension portions 260 can define a first extension adjustment slot 1370 aligned with a corresponding gusset fastener hole 1462 and a first extension fastener hole 1372 aligned with a corresponding gusset adjustment slot 1460. According to example aspects, a first gusset fastener 1320 can pass through each corresponding gusset fastener hole 1462 and first extension adjustment slot 1370, and a second gusset fastener 1322 can pass through each corresponding gusset adjustment slot 1460 and first extension fastener hole 1372. In example aspects, the first and second gusset fasteners 1320, 1322 can be nut and bolt fasteners 1324, as shown, or can be any other suitable fasteners known in the art, such as screws, rivets, and the like. Each of the first gusset fasteners 1320 can be configured to slide within the corresponding first extension adjustment slot 1370 to orient the corresponding extension portions 260 at a desired position relative to the corresponding reinforcement gusset 250. As each of the first gusset fasteners 1320 slides within the corresponding first extension adjustment slot 1370, each of the second gusset fasteners 1322 can slide within the corresponding gusset adjustment slot 1460. The first gusset fasteners 1320 and second gusset fasteners 1322 can then be selectively tightened to secure the extension portions 260 to the corresponding reinforcement gussets 250 at the desired position.

The hinge locking device 100 can further comprise the wall engagement member 280, which can extend between and can be affixed to the extension portions 260 to offset the wall engagement member 280 from the plane in which the mounting plate 200 lies. In the present aspect, the wall engagement member 280 can be substantially U-shaped and can define a pair of opposing plate arms 1380 and a wall engagement cross-member 1390 extending therebetween. The wall engagement cross-member 1390 can define the wall engagement face 282. Each of the extension portions 260 can overlap and be coupled to an upper arm face 1382 of a corresponding one of the plate arms 1380, and each of plate arms 1380 can be substantially parallel to the corresponding extension portions 260. In some aspects, the wall engagement member 280 can be adjustable relative to the extension portions 260 to transpose the wall engagement member 280 forwards and rearwards, relative to the orientation shown. In the present aspect, each of the plate arms 1380 can define a plate adjustment slot 1484 (shown in FIG. 14) and a plate fastener hole 1482 (shown in FIG. 14). Each plate adjustment slot 1484 can be configured to align with a second extension fastener hole 1376 of the corresponding extension portion 260, and each plate fastener hole 1482 can be configured to align with a second extension adjustment slot 1374 of the corresponding extension portion 260.

According to example aspects, a first plate fastener 1330 can pass through each corresponding plate fastener hole 1482 and second extension adjustment slot 1374, and a second plate fastener 1332 can pass through each corresponding plate adjustment slot 1484 and second extension fastener hole 1376. In example aspects, the first and second plate fasteners 1330, 1332 can be nut and bolt fasteners 1334, as shown, or can be any other suitable fasteners known in the art, such as screws, rivets, and the like. Each of the first plate fasteners 1330 can be configured to slide within the corresponding second extension adjustment slot 1374 to orient the wall engagement member 280 at a desired position relative to the extension portions 260. As each of the first plate fasteners 1330 slide within the corresponding second extension adjustment slot 1374, each of the second plate fasteners 1332 can slide within the corresponding plate adjustment slot 1484. The first plate fasteners 1330 and second plate fasteners 1332 can then be selectively tightened to secure the wall engagement member 280 to the extension portions 260 at the desired position. The extension portions 260 and the wall engagement member 280 can be adjustable to accommodate doors 150 (shown in FIG. 16), door frames 180 (shown in FIG. 16), and walls 1190 (shown in FIG. 16) of varying configurations.

Figure 15:
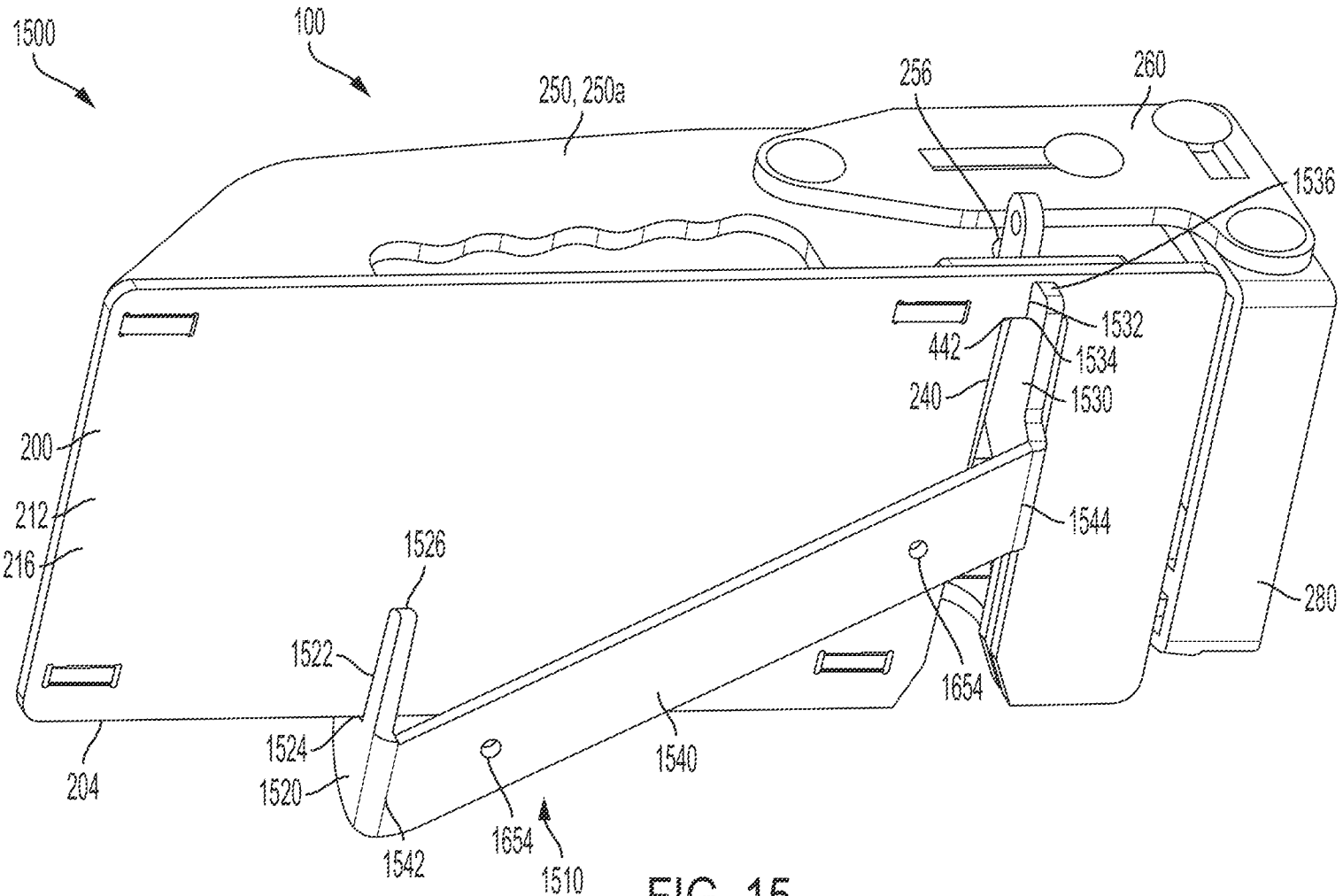
FIG. 15 is a rear perspective view of a hinge locking assembly comprising the hinge locking device of FIG. 13 and a wall mount.

FIG. 15 illustrate the hinge locking device 100 mounted to a wall mount 1510. The wall mount 1510 can be mounted to the wall 1190 (shown in FIG. 16) proximate to the door 150 (shown in FIG. 16) to support the hinge locking device 100 in close proximity to the door 150 when the hinge locking device 100 is not in use. The hinge locking device 100 and the wall mount 1510 can together define a hinge locking assembly 1500. According to example aspects, the wall mount 1510 can define a first mounting arm 1520, a second mounting arm 1530, and a mounting cross-member 1540 extending therebetween. The first mounting arm 1520 can extend from a first cross-member end 1542 of the mounting cross-member 1540, and the second mounting arm 1530 can extend from a second cross-member end 1544 of the mounting cross-member 1540. As shown, the mounting cross-member 1540 can be spaced from the rear plate face 212 of the mounting plate 200, and each of the first and second mounting arms 1520, 1530 can extend towards the mounting plate 200. When mounted to the wall 1190, the mounting cross-member 1540 can be angled upward relative to the horizontal, from the first cross-member end 1542 to the second cross-member end 1544, such that the second mounting arm 1530 can be elevated above the first mounting arm 1520.

According to example aspects, a first mounting slot 1522 can extend into the first mounting arm 1520 at a first upper arm end 1526 thereof, and a second mounting slot 1532 can extend into the second mounting arm 1530 at a second upper arm end 1536 thereof. The first mounting slot 1522 can terminate at a first lower slot end 1524 distal to the first upper arm end 1526 of the first mounting arm 1520, and the second mounting slot 1532 can terminate at a second lower slot end 1534 distal to the second upper arm end 1536 of the second mounting arm 1530. To mount the hinge locking device 100 on the wall mount 1510, the first plate section 216 of the mounting plate 200 can engage the first mounting slot 1522 of the first mounting arm 1520, and the lower plate end 204 of the mounting plate 200 can rest on the first lower slot end 1524. Additionally, the hinge slot 240 of the hinge locking device 100 can engage the second mounting slot 1532 of the second mounting arm 1530, and the upper slot end 442 of the hinge slot 240 can rest on the second lower slot end 1534. In some aspects, a portion of the second mounting arm 1530 can extend through the gusset recess 256 of the upper reinforcement gusset 250*a*, as shown. Example aspects of the wall mount 1510 can further define one or more fastener holes 1654 formed therethrough. For example, in the present aspect, a pair of the fastener holes 1654 can be formed through the mounting cross-member 1540. The fastener holes 1654 are discussed in further detail below with respect to FIG. 16.

Figure 16:
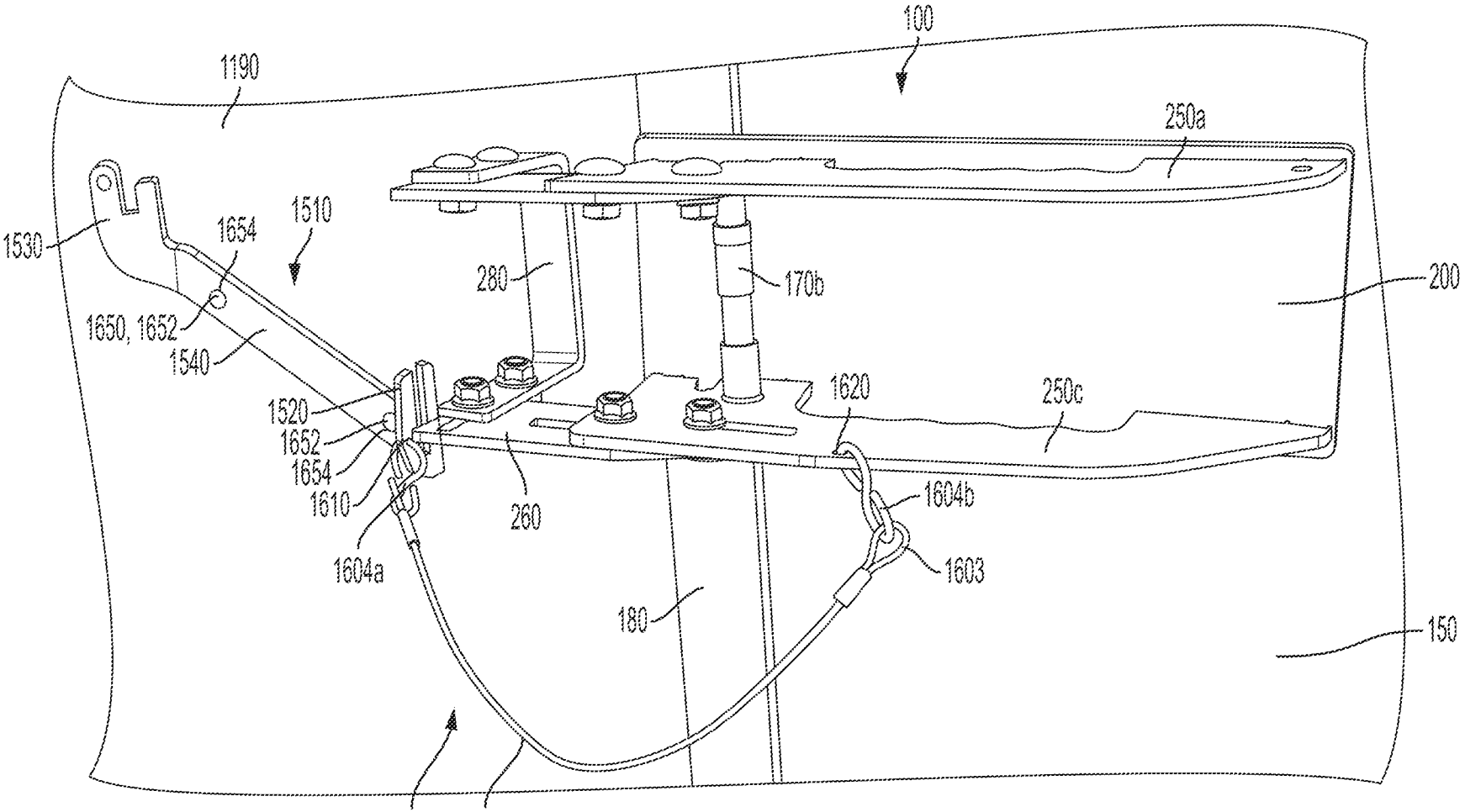
FIG. 16 is a front perspective view the hinge locking device of FIG. 13 mounted on a door, in accordance with another aspect of the present disclosure.

FIG. 16 illustrates the wall mount 1510 mounted to the wall 1190 and the hinge locking device 100 mounted to the corresponding door hinge assembly 170*b* to secure the door 150 in the closed position. The wall mount 1510 can be secured to the wall 1190 by one or more fasteners 1650, such as screws 1652. For example, each of the screws 1652 can extend through a corresponding fastener hole 1654 formed through the mounting cross-member 1540 and can engage the wall 1190 to mount the wall mount 1510 thereon. In other aspects, the fasteners 1650 can be any other suitable fastener known in the art. As shown, in some aspects, the hinge locking device 100 can be tethered to the wall mount 1510 by a tether 1600, such that the hinge locking device 100 can remain connected to the wall mount 1510 even when dismounted therefrom, such as in case the hinge locking device 100 is dropped during use and as a security measure to prevent removal of the hinge locking device 100 away from the door 150. In the present aspect, the tether 1600 can comprise a cord 1602 and a pair of clips 1604*a,b*. Each of the clips 1604*a,b* can be connected to a loop 1603 formed at an opposing end of the cord 1602. The clip 1604*a* can engage a mount clip opening 1610 formed in the wall mount 1510, and the clip 1604*b* can engage a device clip opening 1620 formed in the hinge locking device 100. For example, the mount clip opening 1610 can be formed through the first mounting arm 1520, and the device clip opening 1620 can be formed through the lower reinforcement gusset 250*c*. Other aspects of the hinge locking assembly 1500 may not comprise the tether 1600, or can comprise any other suitable device for connecting the hinge locking device 100 to the wall mount 1510.

Thus, according to example aspects, a method of locking the door 150 in the closed position can comprise sliding the hinge locking device 100 onto the corresponding door hinge assembly 170 of the door 150. Sliding the hinge locking device 100 onto the door hinge assembly 170 can comprise aligning the hinge slot 240 above the hinge plates 272*a,b* and aligning the barrel channel 226 above the hinge barrel 172. It can further comprise lowering the hinge locking device 100 onto the door hinge assembly 170 to engage the hinge plates 272*a,b* with the hinge slot 240 and to engage the hinge barrel 172 with the barrel channel 226. The hinge locking device 100 can rest on the upper hinge end 174 of the door hinge assembly 170. With the hinge locking device 100 mounted on the door hinge assembly 170, the first plate section 216 of the mounting plate 200 can confront the door panel 155 and the second plate section 218 of the mounting plate 200 can confront the door frame 180 to prohibit the door 150 from opening towards the hinge locking device 100. The door 150 can thereby be secured in the closed position. In some aspects, the wall engagement member 280 of the hinge locking device 100 can further confront the wall 1190 surrounding the door frame 180. Additionally, in some aspects, the method can further comprise dismounting the hinge locking device 100 from the wall mount 1510 prior to sliding the hinge locking device 100 onto the door hinge assembly 170. As described above, the wall mount 1510 can be mounted to the wall 1190 adjacent to the corresponding door hinge assembly 170, so that a user can quickly and easily dismount the hinge locking device 100 from the wall mount 1510 and mount the hinge locking device 100 on the door hinge assembly 170. The method can further comprise dismounting the hinge locking device 100 from the door hinge assembly 170 and mounting the hinge locking device 100 on the wall mount 1510 when the hinge locking device 100 is no longer needed to secure the door 150 in the closed position. According to example aspects, the first mounting slot 1522 can engage the mounting plate 200 and the second mounting slot 1532 can engage the hinge slot 240 to support the hinge locking device 100 on the wall mount 1510.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A door locking device comprising:

a mounting plate configured to be mounted to the door;

a reinforcement gusset extending outward from the mounting plate, the reinforcement gusset defining an extension portion; and a wall engagement member adjustably affixed to the extension portion of the reinforcement gusset and laterally offset from the mounting plate;

wherein the wall engagement member is movable relative to the extension portion in a direction substantially perpendicular to the mounting plate, and wherein the extension portion is configured to confront a wall adjacent to the door.

2. The door locking device of claim 1, wherein the mounting plate defines a first plate side and a second plate side opposite the first plate side, and wherein the extension portion of the reinforcement gusset extends laterally beyond the second plate side.

3. The door locking device of claim 2, wherein the extension portion defines a first portion oriented about parallel to the mounting plate and a second portion oriented about perpendicular to the mounting plate, and wherein the wall engagement member is adjustably affixed to the second portion of the extension portion.

4. The door locking device of claim 1, wherein:

one of the extension portion and the wall engagement member defines an adjustment slot;

the other of the extension portion and the wall engagement member defines a fastener hole;

a fastener extends through each of the adjustment slot and the fastener hole to adjustably affix the wall engagement member to the extension portion; and the fastener slides within the adjustment slot to move the wall engagement member relative to the extension portion in the direction substantially perpendicular to the mounting plate.

5. The door locking device of claim 4, wherein the fastener is a nut and bolt-type fastener comprising a nut and a bolt, the bolt extends through each of the adjustment slot and the fastener hole, and the nut can be selectively tightened on the bolt to secure the wall engagement member to the extension portion at a desired position.

6. The door locking device of claim 4, wherein;

the wall engagement member defines an arm and a wall engagement face;

the arm is about perpendicular to the mounting plate and the wall engagement face is about parallel to the mounting plate;

the fastener adjustably affixes the arm to the extension portion; and the wall engagement face is substantially planar and is configured to confront the wall.

7. The door locking device of claim 6, wherein:

the reinforcement gusset is a first reinforcement gusset and the extension portion is a first extension portion;

the door locking device further comprises a second reinforcement gusset about parallel to first reinforcement gusset and extending outward from the mounting plate;

the second reinforcement gusset defines a second extension portion;

the arm of the wall engagement member is a first arm;

the wall engagement member further comprises a second arm about parallel to the first arm and a wall engagement cross-member extending between the first arm and the second arm;

the second arm is adjustably affixed to the second extension portion; and the wall engagement cross-member defines the wall engagement face.

8. The door locking device of claim 1, wherein:

the mounting plate defines a front plate face and a rear plate face opposite the front plate face;

the reinforcement gusset defines a perpendicular gusset portion extending from and oriented about perpendicular to the mounting plate;

the reinforcement gusset further defines a parallel gusset portion oriented about parallel to the mounting plate; and an opening is defined between the front plate face of the mounting plate and the parallel gusset portion of the reinforcement gusset.

9. The door locking device of claim 8, wherein the parallel gusset portion defines a gripping recess, the gripping recess at least partially defines the opening, and the gripping recess defines an undulating profile configured to be gripped by a user.

10. The door locking device of claim 1, wherein the mounting plate defines an upper plate end and a lower plate end opposite the upper plate end, a slot extends longitudinally into the mounting plate at the lower plate end, and the slot is configured to receive a mounting portion of the door to mount the door locking device to the door.

11. The door locking device of claim 10, wherein:

the slot defines a lower slot opening at the lower plate end of the mounting plate;

the slot terminates at an upper slot end between the lower plate end and the upper plate end;

the lower slot opening of the slot is chamfered; and a width of the slot at the lower plate end is greater than a width of the slot at the upper slot end.

12. A method of using a door locking device, the method comprising:

mounting a mounting plate of the door locking device to a door, the door locking device further comprising a reinforcement gusset extending from the mounting plate and a wall engagement member adjustably affixed to the reinforcement gusset;

moving the wall engagement member relative to the reinforcement gusset in a direction substantially perpendicular to the mounting plate;

securing the wall engagement member in position relative to the reinforcement gusset; and confronting a wall surrounding the door with a wall engagement face of the wall engagement member.

13. The method of claim 12, wherein mounting the mounting plate of the door locking device to the door comprises receiving a mounting portion of the door within a slot of the mounting plate, and wherein the slot extends longitudinally into the mounting plate at a lower plate end of the mounting plate.

14. The method of claim 13, wherein the reinforcement gusset comprises a gripping recess, and wherein mounting the mounting plate of the door locking device to the door further comprises gripping the gripping recess, aligning the slot of the mounting plate over the mounting portion of the door, and sliding the slot down over the mounting portion.

15. The method of claim 12, wherein:

one of the reinforcement gusset and the wall engagement member defines an adjustment slot;

the other of the reinforcement gusset and the wall engagement member defines a fastener hole;

a fastener extends through each of the adjustment slot and the fastener hole to adjustably affix the wall engagement member to the reinforcement gusset; and moving the wall engagement member relative to the reinforcement gusset comprises sliding the fastener within the adjustment slot.

16. The method of claim 15, wherein:

the fastener is a nut and bolt-type fastener comprising a nut and a bolt;

the bolt extends through each of the adjustment slot and the fastener hole; and securing the wall engagement member in a desired position relative to the reinforcement gusset comprises tightening the nut on the bolt.

* * * * *